US011712092B2

(12) United States Patent
Deleon

(10) Patent No.: US 11,712,092 B2
(45) Date of Patent: Aug. 1, 2023

(54) BANDED SPINNING DEVICE AND WATCH

(71) Applicant: DELRA PRODUCTS LLC, Yakima, WA (US)

(72) Inventor: Ralph Deleon, Yakima, WA (US)

(73) Assignee: DELRA PRODUCTS LLC, Yakima, WA (US)

( * ) Notice: Subject to any disclaimer, the term of this patent is extended or adjusted under 35 U.S.C. 154(b) by 0 days.

(21) Appl. No.: 17/539,073

(22) Filed: Nov. 30, 2021

(65) Prior Publication Data

US 2023/0165342 A1 Jun. 1, 2023

(51) Int. Cl.
*A44C 5/14* (2006.01)

(52) U.S. Cl.
CPC ..... *A44C 5/14* (2013.01)

(58) Field of Classification Search
CPC ..... A44C 5/14
See application file for complete search history.

(56) References Cited

U.S. PATENT DOCUMENTS 5,102,023 A * 4/1992 Nguyen ..... A44B 11/001 224/163
5,917,780 A * 6/1999 Berestov ..... G04B 37/1486 368/282
7,146,731 B2 * 12/2006 Kraus ..... G04B 37/1486 148/559
10,212,994 B2 * 2/2019 Watterson ..... A44C 5/0015
10,261,473 B2 * 4/2019 Bell ..... G04B 37/0033
10,524,548 B2 * 1/2020 Park ..... A44C 5/025
11,330,874 B2 * 5/2022 Kyung ..... A44C 5/14
2006/0126444 A1 * 6/2006 Ellner ..... A45F 5/00 368/246
2007/0097688 A1 * 5/2007 Gibbons ..... A44C 5/0069 362/282
2013/0305780 A1 * 11/2013 Christ ..... A44C 5/0007 63/3.1
2017/0035190 A1 * 2/2017 Gilmore ..... A44C 5/0053
2020/0329833 A1 * 10/2020 Matsunaga ..... A44C 5/14

* cited by examiner

*Primary Examiner* — Robert Sandy
*Assistant Examiner* — Louis A Mercado
(74) *Attorney, Agent, or Firm* — Svendsen Legal, LLC

(57) ABSTRACT

A spinning device attachable to a band, including a watch and with the spinning device rotatably mounted on a spin-able mount with a bearing and attached to a band, the band receivable onto a user's wrist or finger. The wrist-mounted, or alternatively finger-mounted spinner device includes a watch, mounted in a stationary position, or alternatively in a rotatable position above the spinner device. The spin-able mount includes a spinner bearing attached to a band, the spin-able mount rotatable about the spinner bearing mounted between a post nut and a base screw. The base screw of the spin-able mount receives a bottom band washer and a top band washer, with the top band washer firmly sandwiching the band.

14 Claims, 7 Drawing Sheets

BANDED SPINNING DEVICE AND WATCH

TECHNICAL FIELD

The present disclosure relates to a spinning device and watch, attachable to a band. More specifically, the present disclosure relates to a wrist-mounted, or alternatively a finger-mounted spinner device that includes a watch, the spinner device rotatably mounted on a bearing and attached to a band, the band receivable onto a user's wrist or finger.

BACKGROUND

Development of the disclosed device was motivated by existing "spinner" types of devices, and ways to render these devices more easily accessible, multi-functional, and portable. There also is a need for a better mounting system for such devices. The following disclosure of the present invention will be understood by reference to the following detailed description, taken in conjunction with the accompanying drawings

BRIEF DESCRIPTION OF DRAWINGS

Exemplary embodiments of the technology will become more fully apparent from the following description and appended claims, taken in conjunction with the accompanying drawings. Understanding that these drawings depict only exemplary embodiments and are, therefore, not to be considered limiting of the scope of the technology, the exemplary embodiments will be described with additional specificity and detail through use of the accompanying drawings in which:

Figure 1:
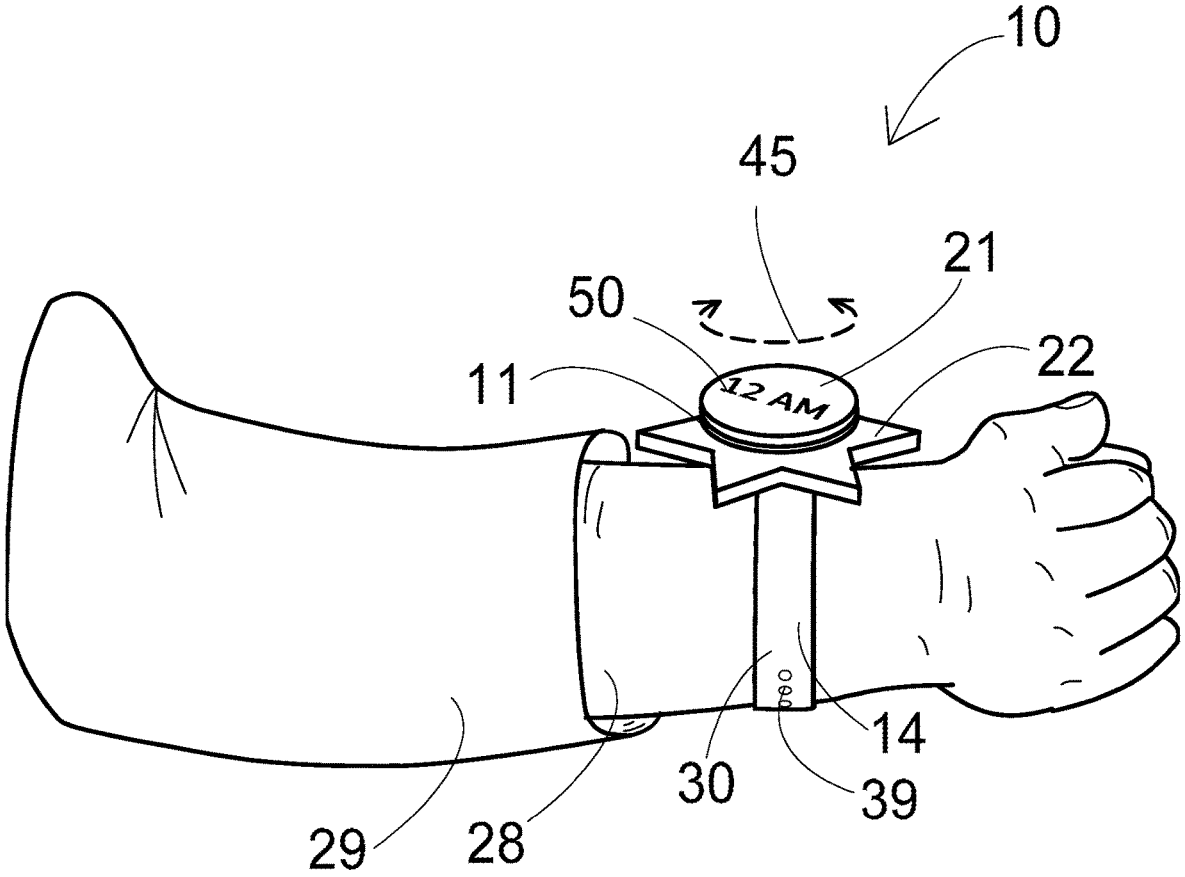
FIG. 1 is an isometric view of a banded spinning device and watch, according to an embodiment of the invention.

Reference characters included in the above drawings indicate corresponding parts throughout the several views, as discussed herein. The description herein illustrates one preferred embodiment of the invention, in one form, and the description herein is not to be construed as limiting the scope of the invention in any manner. It should be understood that the above listed figures are not necessarily to scale and may include fragmentary views, graphic symbols, diagrammatic or schematic representations. Details that are not necessary for an understanding of the present invention by one skilled in the technology of the invention, or render other details difficult to perceive, may have been omitted.

DETAILED DESCRIPTION OF SPECIFIC EMBODIMENTS

Exemplary embodiments of a banded spinning device and watch 10 will be best understood by reference to the drawings included herewith, wherein like parts are designated by like numerals throughout. It will be readily understood that the components of the device, as generally described and illustrated in the figures herein, could be arranged and designed in a wide variety of different configurations. Thus, the following more detailed description of the embodiments of the apparatus, system, and device is not intended to limit the scope of the invention, as claimed, but is merely representative of exemplary embodiments of the technology.

Referring to FIGS. 1 through 6, the banded spinning device and watch 10 of the present invention, as embodied in a watch platform 11, as attached to a spin-able mount 12 on a band 14. In a most preferred embodiment, as shown in a side view in FIG. 3, the banded spinning device and watch may be referred herein in the alternative as a "spinner and watch mounted to a band," with the watch platform or "spinner watch" including a watch device 21 attached above a spin platform 22, and the spin platform received on a spinner bearing 15 of the spin-able mount.

Figure 5:
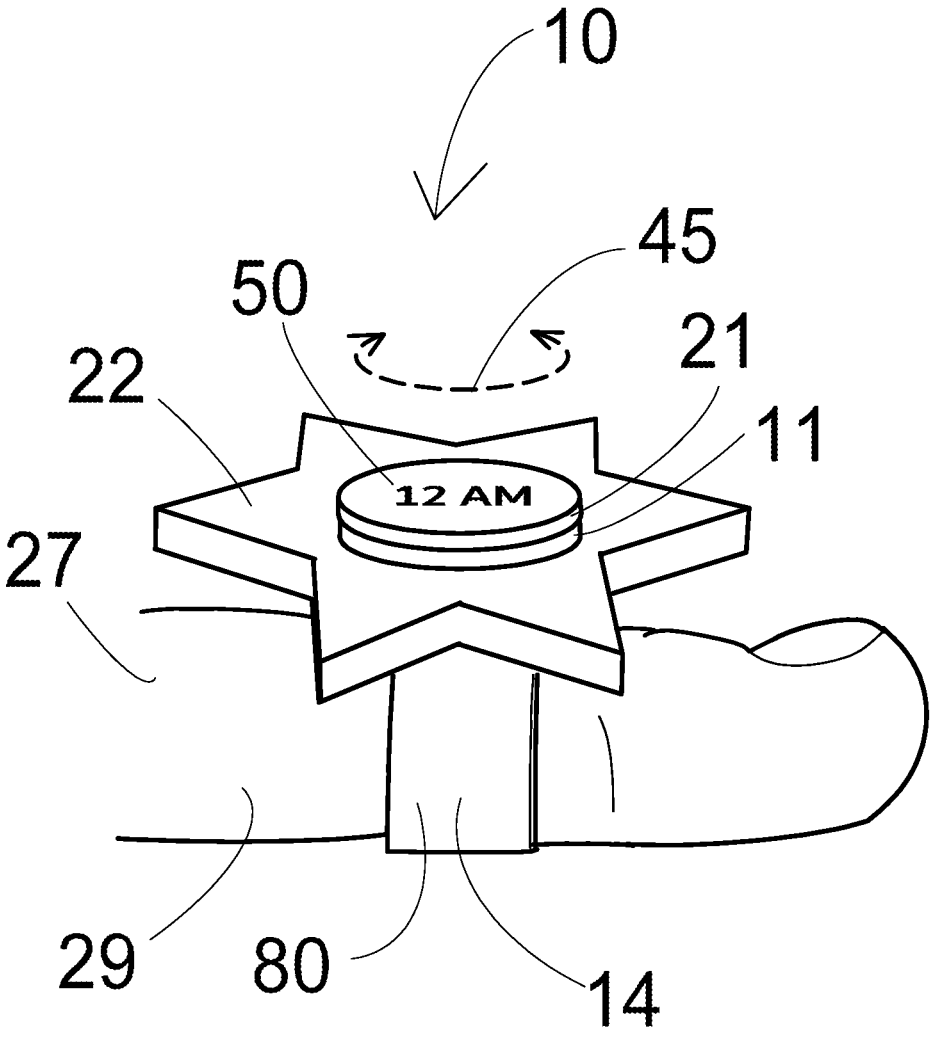
FIG. 5 is a an isometric view of a banded spinning device, according to an embodiment of the invention.

The band 14 may be made of a synthetic or a natural cloth, a plastic, or a metal material, and can be elastic or include expandable elements to fit snuggly on a user's appendage 27, which may be an user's arm 28 (simply referred to as an arm) as shown in FIG. 1, or a user's finger 29 (simply referred to herein as a finger) as shown in FIG. 5, as examples. The band may be any conventional type or style of band, or strap as is known to those persons skilled or familiar with bands employed for bracelets, rings, watches, and finger or wrist mounted devices.

Figure 2:
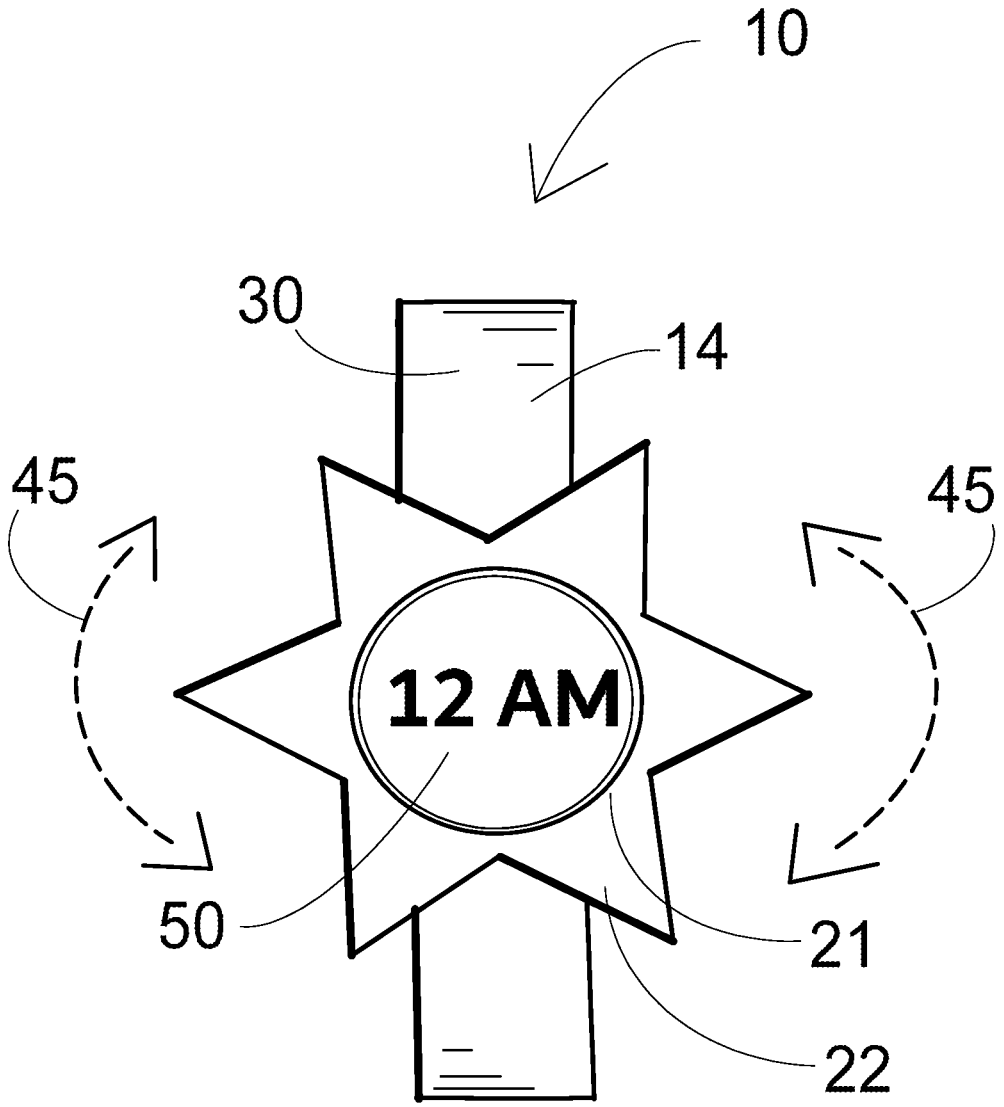
FIG. 2 is a top view of the banded spinning device and watch, according to an embodiment of the invention.
Figure 4A:
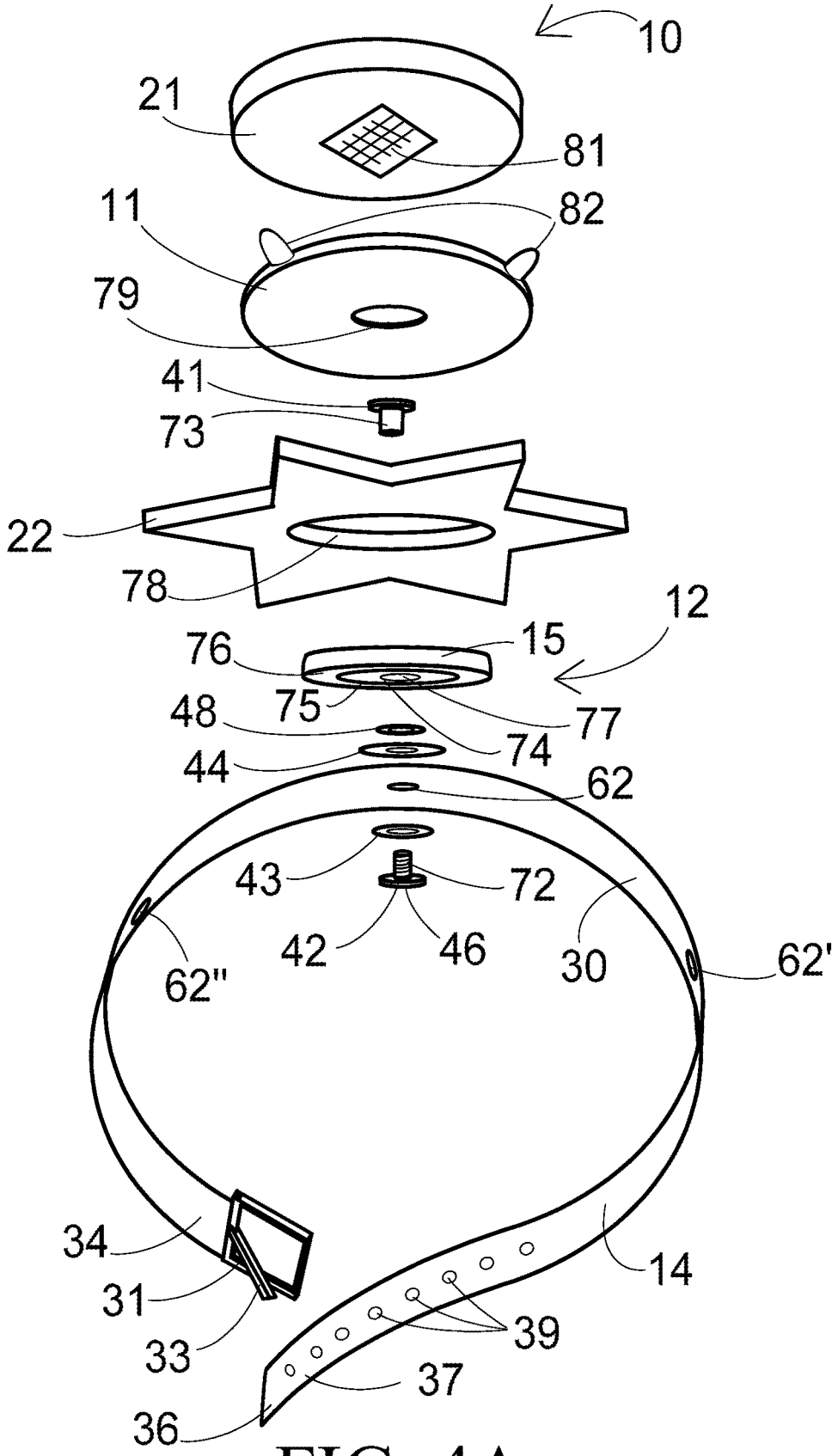
FIG. 4A is an exploded isometric view of a banded spinning device and watch, according to an embodiment of the invention.

A preferred band 14 for use with the banded spinning device and watch 10 on the user's arm 28 as shown in FIG. 1, is detailed in FIG. 2. Most preferably, as shown in FIG. 4A, the band is a wrist-strap 30 made of plastic webbing, and includes a buckle 31 and a buckle prong 33 at a first strap-end 34, and includes an end tip 36 at a second strap-end 37. Additionally, a multiple of prong-holes 39 are included along the strap and proximate to the second strap-end, to fasten the wrist-band at any one of the multiple of prong-holes. With the end tip received into the buckle and the prong received into one of the multiple of prong-holes, the first strap-end is fastened within the buckle, and secured to the second strap-end.

Figure 3:
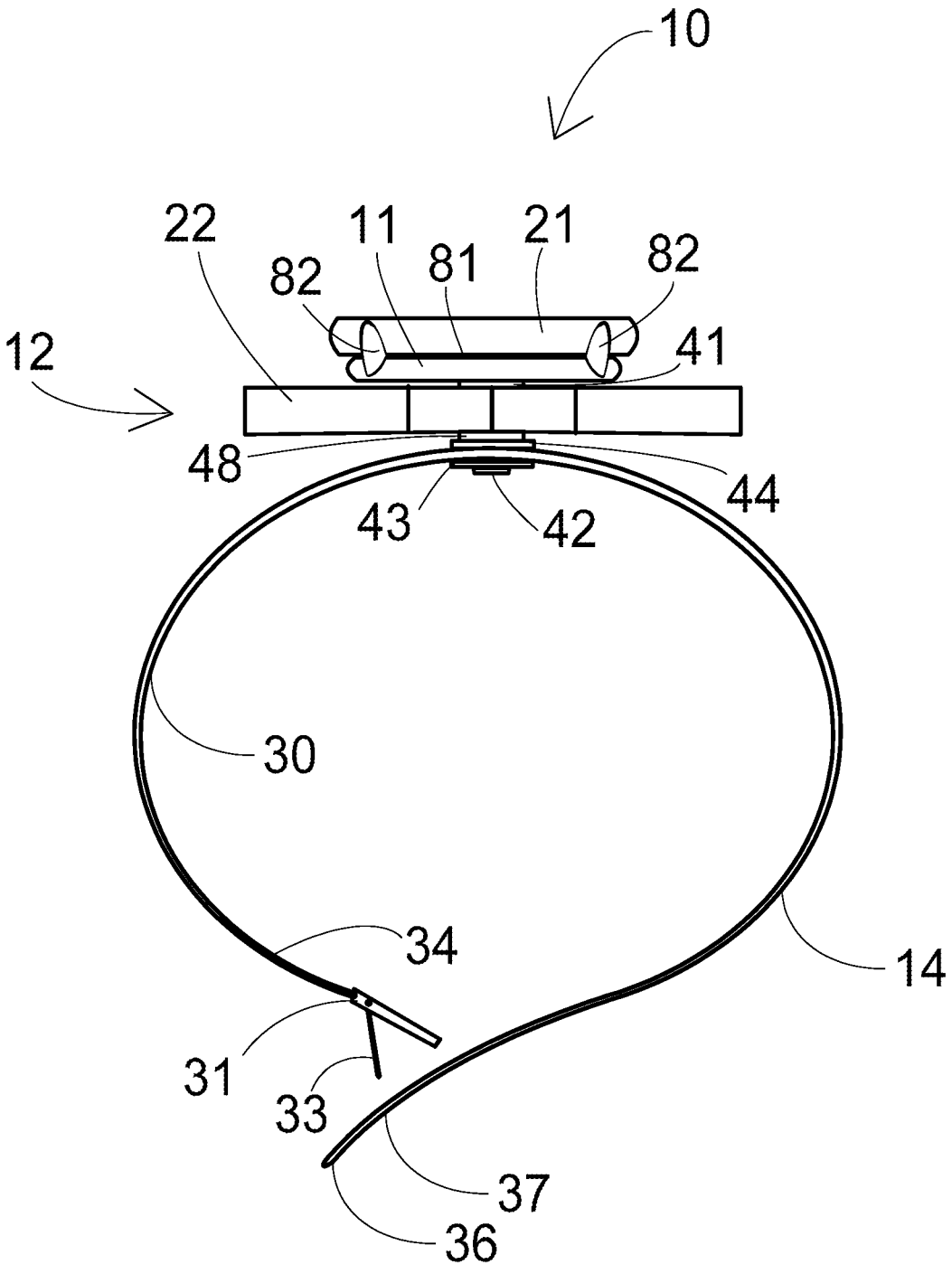
FIG. 3 is a side view of a banded spinning device and watch, according to an embodiment of the invention.

FIG. 3 shows a preferred embodiment of the banded spinning device and watch 10 that includes the watch platform 11 attached atop the spin-able mount 12, and the spin-able mount attached to the band 14. The spin-able mount has a multiple of parts and is rotatable about the spinner bearing 15, including the spinner bearing mounted between a post nut 41 and a base screw 42.

Additionally for the spinner mount 12, the base screw 42 of the spin-able mount preferably receives a bottom band washer 43 and a top band washer 44. Alternatively, the bottom band washer can be incorporated into the base screw, or most preferably the base screw can include a base head 46 of a sufficient diameter, which renders the addition of the bottom band washer unnecessary. The bottom band washer and the top band washer firmly sandwich the band 14, as shown in FIGS. 3 and 4A.

Also as shown in the disassembled or exploded view of FIG. 4A, a spacer washer 48 fits onto the base screw 42 and fits over the top band washer 44. The spinner bearing 15 then fits over the spacer washer. The spring bearing is preferably a standard "slewing ring" or "turntable" type of bearing, and includes an inner ring 74 separated from an outer ring 76 by a rolling element 75. The spinner bearing can be any conventional type of rotatable bearing, as is preferably a sealed ring bearing. Most preferred a pre-lubricated, sealed slewing ring bearing is employed, with either rollers or ball bearings included in the rolling element, within the spinner bearing.

The inner ring 74 of the spinner bearing 15 includes a bearing hole 77, also as shown in FIG. 4A, and because of the rolling element 75, the outer ring rotates freely about the inner ring that is supported on the spacer washer 48, with the spacer washer having a diameter approximately equal to the inner ring, to keep the outer ring from contacting the top band washer 44. Additionally, the post nut 41 mounts to the base screw 42 to clamp and hold the inner ring of the bearing between the spacer washer and the post nut.

The spin platform 22 is mounted to the outer ring 76 of the spinner bearing 15 preferably as shown in FIG. 4A, with the outer ring 76 of the spinner bearing received into a spinner hole 78. Any permanently bonding glue or adhesive can be used to set the spinner bearing within the spinner hole, and the spin platform rotates freely with the outer ring of the spinner bearing. Alternatively, any well known mounting method could be used to attach the spin platform to the spinner bearing. For instance, a heat-fused or a soldered mounting could be employed, or a threaded and screwed attachment or any rotatable and potentially detachable mount of the spin platform to the outer ring of the spinner bearing.

To assemble the preferred embodiment of the banded spinning device and watch 10 shown disassembled in FIG. 4A, the base screw 42 receives the bottom band washer 43 and is received through a band hole 62 in the band 14. The base screw then receives the top band washer 44 and then the spacer washer 48. The spinner bearing 15 sets upon the spacer washer, with the base screw received through the bearing hole 77 of the inner ring. The post nut 41 then mounts to the base screw, preferably with a threaded connection. Specifically, the base screw preferably includes a threaded pillar 72 that screws into a threaded socket 73 within the post nut.

Any rotatable attachment of the base screw 42 to the band 14, as known to those persons skilled in selecting rotating mounts, could be used. For instance, a glued or fused mounting could be employed, or a screwed washer pair that clamps to or sandwiches the wrist-strap 30 with the rotatable attachment of the spin-able mount 12.

Alternatively, as shown in FIG. 4A, the band hole 62 could be shifted about the band 14 to a position at a first alternative band hole 62', shifted approximately ninety-degrees on the band, relative to the band hole 62. Also as an alternative as shown in FIG. 4A the band hole could be shifted about the band to a position at a second alternative band hole 62", also shifted approximately ninety-degrees on the band, relative to the band hole. These alternative positions of the band hole allows a user to disassemble the banded spinning device and watch 10, so they can reassemble it from the conventional, top mounted position of the spin-able mount 12 to a side mount. Also, this alternative position allows the excess strap at the second strap end 37 to be either towards or away from user, however the user desires.

The spin platform 22 attaches to the outer ring 76 of the spinner bearing 15 of the spin-able mount in the banded spinning device and watch 10, again with the outer ring 76 of the spinner bearing received into the platform hole 78, as shown in the preferred embodiment of FIG. 4A, and the spin platform able to rotate freely on the spin-able mount 12. Preferably, the spin platform and the spinner bearing are removable from spin-able mount 12 with a disassembly of the post nut 41 from the base screw 42, especially with the threaded pillar 72 of the post nut screwed into the threaded socket 73 of the base screw as most preferred, and with the spin platform permanently attached to the outer ring of the spinner bearing, as shown in FIG. 3.

Any fixed attachment for the post nut 41 to the spin platform 22, as known to those persons skilled in selecting attachments, could be used. For instance, a preferred glued or a heat fused mounting could be employed, a permanent rivet, or a removable and temporarily screwed washer pair that clamps the spin platform to the post nut could be used in the alternative.

Referring to FIG. 4A showing a preferred embodiment of the banded spinning device and watch 10, the watch platform 11 is attached to the spin platform 22. Specifically, as preferred, the watch platform includes a cap seat 79 that receives the post nut 41. The cap seat is a hollowed out or concave portion of the watch platform. The watch platform is free to rotate along with the spin platform, with the post nut stationary within the cap seat under the watch platform. The watch platform attachment to the spin platform is preferably a permanently glued mounting, with a screwed or a heat fused mounting employed in the alternative. Most preferably, the watch platform is directly attached to and rotates with the spin platform, with the spin-able mount 12 able to rotate freely and "spin" to any rotatable position 45, as shown in FIGS. 1, 2, 5, and 6.

Figure 4B:
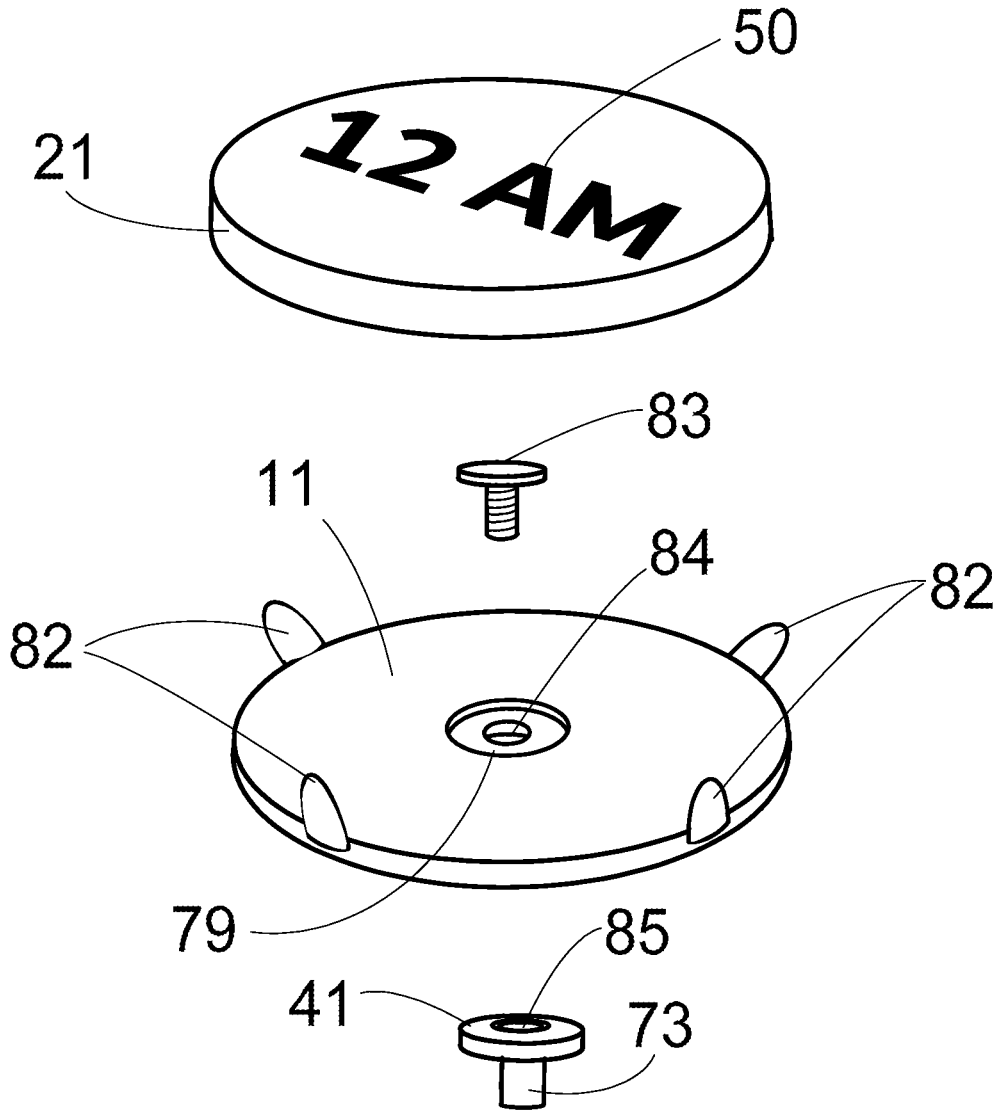
FIG. 4B is an exploded isometric view of a portion of a banded spinning device and watch, according to an embodiment of the invention.

In the alternative to the watch platform 11 directly attached to and able to rotate with the spin platform 22, the watch device 21 instead can be mounted to the post nut 41 and remain in a stationary position above the spin platform. For this alternative embodiment, as shown in FIG. 4B, the watch platform can include a watch screw 83, and the post nut can included a threaded cap socket 85. The watch screw sets into a cap hole 84 within the cap seat 79 of the watch platform and is received into the post nut, and so the watch device 21 held within the watch platform is held in a stationary position on the post nut and base screw 42. Alternatively, the watch platform could be mounted onto the post nut with a glued, welded, or any other connection type as would be known to those skilled in such connections or attachments.

The watch device 21 can be mounted to the watch platform 11, preferably with a temporary watch attachment 81 as shown in FIG. 4A, and secured to or coupled to the watch platform by any selected conventional attachment, including but not limited to a glued, welded, screwed, clipped, clamped, or preferably by a hook and loop (VELCRO®) attachment.

Alternatively or in addition to the temporary watch attachment 81, the watch device 21 can be mounted to the watch platform 11 with the aid of watch prongs 82, as shown in FIGS. 3, 4A, and 4B. The watch device can be set onto the watch platform, the watch prongs can be bent to grasp and secure the watch device onto the watch platform. Most preferably, if the watch prongs are used, four watch prongs can be spaced along the outer perimeter of the watch platform. With the watch prongs formed from a bendable metal material, as preferred, the watch device can be removed or substituted for a different watch device, as desired.

The watch device 21 for use with the banded spinning device and watch 10 can be any of a variety of watch or watch-like elements as are well-known, including a digital watch, an analog watch, or a 'smart' or personal computer watch, personal digital assistant or "PDA", with a display 50, as shown in FIGS. 1, 2 and 4B. The display of the watch may have any possible face, or serve to display any single or a multiple of functional application.

An important feature and advantage of the banded spinning device and watch 10 of the present invention is that the watch platform can be oriented as desired for use as a "spinner watch," to be spun or to be oriented on the user's arm 28 to any rotational position 45, as shown in FIGS. 1 and 3.

The rotational position 45 most convenient may be any position desired for best viewing of the display 50 of the watch device 21 as positioned on the banded spinning device and watch 10. Additionally, the spin platform 12 can operate as a "fidget spinner" for calming effect, or to keep a person occupied.

Instead of the banded spinning device and watch 10 being used on a wrist strap as the band 14, the banded spinning device and watch can be used on a finger-strap 80, as shown in FIG. 5. The finger strap can be slipped on or off of the user's finger 29, and like the wrist-strap 30, the finger-strap can be a band or loop made of any conventional materials, including metal, cloth, and elastic.

Figure 6:
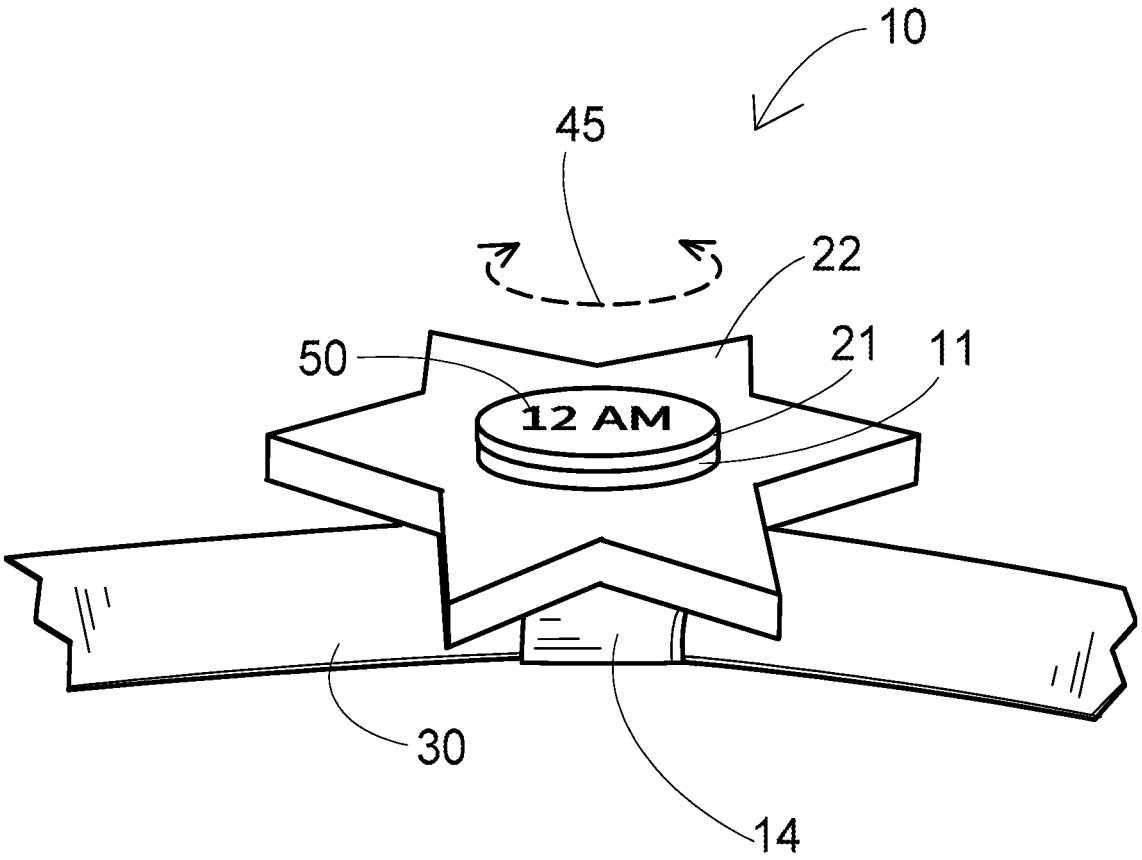
FIG. 6 is an isometric view of a banded spinning device and watch, according to an embodiment of the invention.

Additionally, as shown in FIG. 6, the wrist-strap 30 can be sized to receive the finger-strap 80, so that banded spinning device and watch 10 can be converted back-and-forth with ease, from attachment to the user's finger 29 to the user's arm 28.

Uniquely, the watch device 21, the spin platform 22, and the band 14 of the banded spinning device and watch 10 may all be interchangeable, tradable, and collectable, as shown in FIGS. 4A, 4B, 5 and 6. This feature adds value and variation to the spinner watch mounted wrist-band system with the customization of the system at the whim of the purchaser or user.

The terms "connected", "attached", "coupled" and "mounted" refer to any form of interaction between two or more elements, including mechanical, electrical, magnetic, electromagnetic, fluid, and thermal interaction. Two components may be functionally coupled with or to each other, even though they are not in direct contact with each other.

Also, the terms "approximately" or "approximate" are employed herein throughout, including this detailed description and the attached claims, with the understanding that is denotes a level of exactitude commensurate with the skill and precision typical for the particular field of endeavor, as applicable.

Additionally, the terminology used in this application is to be interpreted according to ordinary and customary usage in the field of the invention as exemplified in the pertinent U.S. and International Patent Classification Codes, and equivalent codes in other patent classification systems.

The word "embodiment" is used herein to mean "serving as an example, instance, or illustration." Any embodiment described herein is not necessarily to be construed as preferred or advantageous over other embodiments. While the various aspects of the embodiments are presented in drawings, the drawings are not necessarily drawn to scale.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, a drawing figure "FIG." a multiple of drawing figures "FIGs", or descriptions thereof for the purpose of streamlining this disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

In compliance with the statutes, the invention has been described in language more or less specific as to structural features and process steps where applicable. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

The invention claimed is:

1. A banded spinning device and watch, comprising:

a spin-able mount including a spinner bearing, a post nut and a base screw, the spinner bearing attached to a band, the spin-able mount rotatable about the spinner bearing, and the spinner bearing mounted between the post nut and the base screw;

the base screw of the spin-able mount receives a bottom band washer and a top band washer, and the bottom band washer with the top band washer firmly sandwich the band;

a spacer washer fitted onto the base screw over the top band washer, and the spinner bearing fitted over the spacer washer;

a spin platform having a spinner hole, the spin platform mounted to an outer ring of the spinner bearing, with the outer ring of the spinner bearing received into the spinner hole, and the spin platform freely rotatable with the spin-able mount; and a watch platform, the watch platform set atop the spin-able mount, and a watch mounted onto the watch platform.

2. The banded spinning device and watch of claim 1, additionally wherein:

the watch platform is attached atop the spin-able mount; and the watch platform rotates with a rotation of the spin-able mount.

3. The banded spinning device and watch of claim 1, additionally wherein:

the watch platform is attached atop the base screw of the spin-able mount; and the watch platform is fixed in position and independent of a rotation of the spin-able mount.

4. The banded spinning device and watch of claim 1, additionally wherein: the spacer washer has a diameter approximately equal to an inner ring of the spinner bearing, and the spacer washer prevents the outer ring of the spinner bearing from contacting the top band washer of the spin-able-mount.

5. The banded spinning device and watch of claim 1, additionally wherein the band is receivable onto a user's wrist.

6. The banded spinning device and watch of claim 1, additionally wherein the band is receivable onto a user's finger.

7. The banded spinning device and watch of claim 6, additionally wherein the band receives a wrist-strap, and the wrist-strap is receivable onto a user's wrist.

8. A banded spinning device and watch, comprising:

a spin-able mount including a spinner bearing, a post nut and a base screw, the spinner bearing attached to a band, the spin-able mount rotatable about the spinner bearing, and the spinner bearing mounted between the post nut and the base screw;

the base screw of the spin-able mount receives a bottom band washer and a top band washer, and the bottom band washer with the top band washer firmly sandwich the band;

a spacer washer fitted onto the base screw over the top band washer, and the spinner bearing fitted over the spacer washer;

the spinner bearing including an inner ring separated from an outer ring by a rolling element, the inner ring of the spinner bearing including a bearing hole, and the outer ring rotates freely about the inner ring;

the post nut mounts to the base screw to clamp and hold the inner ring of the spinner bearing between the spacer washer and the post nut;

a spin platform having a spinner hole, the spin platform mounted to the outer ring of the spinner bearing, with the outer ring of the spinner bearing received into the spinner hole, and the spin platform freely rotatable with the spin-able mount; and a watch platform, the watch platform set atop the spin-able mount, and a watch mounted onto the watch platform.

9. The banded spinning device and watch of claim 8, additionally wherein:

the watch platform is attached atop the spin-able mount; and the watch platform rotates with a rotation of the spin-able mount.

10. The banded spinning device and watch of claim 8, additionally wherein:

the watch platform is attached atop the base screw of the spin-able mount; and the watch platform is fixed in position and independent of a rotation of the spin-able mount.

11. The banded spinning device and watch of claim 8, additionally wherein:

the spacer washer has a diameter approximately equal to the inner ring of the spinner bearing, and the spacer washer prevents the outer ring of the spinner bearing from contacting the top band washer of the spin-able-mount.

12. The banded spinning device and watch of claim 8, additionally wherein the band is receivable onto a user's wrist.

13. The banded spinning device and watch of claim 8, additionally wherein the band is receivable onto a user's finger.

14. The banded spinning device and watch of claim 13, additionally wherein the band receives a wrist-strap, and the wrist-strap is receivable onto a user's wrist.

* * * * *